US005895149A

United States Patent [19]

Weed

[11] Patent Number: 5,895,149

[45] **Date of Patent: *Apr. 20, 1999**

[54] TONER SUPPLY INSERT

[75] Inventor: John M. Weed, Murrysville, Pa.

[73] Assignee: Ricoh Company, Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/814,698

[22] Filed: Mar. 11, 1997

Related U.S. Application Data

[63] Continuation of application No. 08/429,645, Apr. 27, 1995, abandoned.

[51] Int. Cl.[6] ..... G03G 15/08

[52] U.S. Cl. ..... 399/262; 399/258

[58] Field of Search ..... 399/109, 110, 399/119, 120, 258, 262

[56] References Cited

U.S. PATENT DOCUMENTS

| | | | |
|---|---|---|---|
| 3,337,072 | 8/1967 | Del Vechio et al. | 214/304 |
| 4,091,765 | 5/1978 | Lowthorp et al. | 118/658 |
| 4,611,730 | 9/1986 | Ikesue et al. | 222/167 |
| 4,688,926 | 8/1987 | Manno | 355/260 |
| 4,732,277 | 3/1988 | Smith | 355/260 X |
| 4,827,307 | 5/1989 | Zoltner . | |
| 4,878,603 | 11/1989 | Ikesue et al. | 222/167 |
| 5,030,997 | 7/1991 | Michlin et al. | 355/260 |
| 5,034,776 | 7/1991 | Sugiura . | |
| 5,118,013 | 6/1992 | Mutou et al. | 222/171 |
| 5,235,389 | 8/1993 | Kikuchi et al. | 355/260 |
| 5,261,568 | 11/1993 | Corby et al. | 222/DIG. 1 X |
| 5,337,126 | 8/1994 | Michlin . | |
| 5,385,181 | 1/1995 | Bhagawat et al. | 355/260 X |
| 5,392,963 | 2/1995 | Kelly et al. | 222/DIG. 1 X |
| 5,414,499 | 5/1995 | Yahata | 355/260 |

*Primary Examiner*—Sandra Brase
*Attorney, Agent, or Firm*—Oblon, Spivak, McClelland, Maier & Neustadt, P.C.

[57] ABSTRACT

A toner supply insert adapted to be inserted into an empty toner supply cartridge to provide a resupplied cartridge capable of dispensing toner. The toner supply insert includes a substantially hollow container having a generally cylindrical wall having a longitudinal axis, an insert rear portion including a closed end, an insert front portion including an open end, and a transition piece connecting the insert front portion to the insert rear portion. A quantity of toner is provided within the toner supply insert. A seal member caps the open end and includes a tab suitable for removing the seal member. A handle capable of being connected to the toner supply insert for removing the insert when the insert is empty may also be provided.

12 Claims, 5 Drawing Sheets

TONER SUPPLY INSERT

This application is a continuation of application Ser. No. 08/429,645, filed on Apr. 27, 1995, now abandoned, the contents of which are hereby incorporated by reference.

FIELD OF THE INVENTION

The present invention relates to an apparatus for dispensing particulate matter, such as a powder or granulated material, into an electrophotographic type reproduction machine, or the like, and more particularly relates to a toner supply insert for insertion into an empty toner supply cartridge.

BACKGROUND OF THE INVENTION

In typical electrophotographic type reproduction machines, during the course of each operating cycle, latent electrostatic images of the subject matter being reproduced are generated on a moving recording member. The recording member typically comprises a layer of photoconductive insulating material on a conductive backing, is given a uniform electric charge over its surface and is then exposed to the subject matter to be reproduced, usually by conventional projection techniques. This exposure creates an electrostatic latent image on the coating on the recording member. Following exposure, the latent electrostatic images on the recording member are developed at a developing station through the use of a developer mixture. In electrophotographic type reproduction machines that use dry developers for developing electrostatic images, the typically employed developer mixture includes a toner material and a carrier material. The developed image is then transferred at a transfer station to a support material, such as a sheet of paper. Subsequently, the developed image is fixed by any suitable means to provide a permanent image or reproduction.

Conventionally, image forming devices, such as laser printers and facsimile machines, employ an exposure system, a photocopier and a developer. An electrostatic latent image is formed on the photoreceptor by exposing it to laser light and the latent image is subsequently developed into a visible toner powder image. The visible toner image is then transferred from the photoreceptor onto a physical medium, such as a sheet of paper. The photoreceptor is typically a portable drum having a photosensitive surface. Processing stations are sequentially disposed around the photoreceptor and are fixed in position with respect to each other and to the photoreceptor. Such processing stations generally include a charging station, an exposure station, a developing station and a transfer station.

The charging station imparts an electrical charge onto the photosensitive surface of the photoreceptor and typically includes a corona charging wire. The electrical charge enables the toner image to be formed on the photoreceptor. The exposure station stations forms an electrostatic latent image on the photosensitive surface of the photoreceptor through an imaging light source (laser beam). The developing station develops the latent image on the photosensitive surface of the photoreceptor into the visible toner image and typically includes a supply of tone, such as powder, and a developing roller that transfers the toner powder onto the photoreceptor. The transfer station transfers the visible toner powder from the photoreceptor to the paper sheet, generally by use of a transfer wire.

In addition, a fixing device is provided which fixes or stabilizes the visible image on the paper sheet and enables the paper sheet to be handled without destroying the image. The fixing device typically works on the principle of heat and pressure rollers. A residual toner removing device, such as a cleaning blade, is also provided for removing toner that remains on the photoreceptor after the toner image has been transferred to the paper sheet. A discharge of pre-exposure station, such as an erase light, may also be provided to remove any residual electrical charge on the photoreceptor after the image has been transferred to the paper sheet. The discharge station is typically positioned between the toner removing device and the corona charging station.

During the development of such images, the toner portion of the developer mixture is depleted. In order to maintain the requisite portion of toner, fresh toner must be resupplied periodically. The means for supplying fresh toner must operate smoothly and consistently and must be reliable as well as leak-free for an electrophotographic machine or the like to operate properly.

Various types of toner resupply systems are known in the prior art as, for example, the toner cup or cartridge types shown by U.S. Pat. Nos. 3,337,072 (Del Vecchio et al.), 4,091,765 (Lowthorp et al.), 5,118,013 (Mutou et al.) and 5,235,389 (Kikuchi et al.). All four of these prior art arrangements disclose a toner dispensing cartridge consisting of relatively rotatable inner and outer concentric cylinders, each with a toner dispensing opening or openings. The supply of fresh toner is held in the inner cylinder, and by rotating the inner cylinder relative to the outer cylinder, the discharge openings of each cylinder are brought into alignment thereby allowing for the dispensing of toner. To close the dispensing openings, the inner cylinder is again rotated relative to the outer cylinder such that the inner cylinder toner dispensing openings are closed by the inner surface of the outer cylinder.

One disadvantage of these concentric cylinder-type designs is that a deformation of either the inner or outer cylinder will make it impossible to achieve a desired smooth, rotational sliding motion between the outer surface of the inner cylinder and inner surface of the outer cylinder. Rather, such deformation will cause these portions of the cylinders to rub together. This interference between the cylinders will lead to abrading. As these portions of the cylinders become worn and damaged, the cylinders will no longer be able to rotate properly relative to each other thereby causing the improper dispensing of toner or lack thereof and/or leakage. Further, with the concentric cylinder design, large surface areas of the cylinders have the potential of interfering with each other due to deformation at any given time. The more surface contact between the cylinders, the greater the likelihood that a deformation in either cylinder will impede the proper functioning of the cartridge.

Similarly, U.S. Pat. No. 5,030,997 (Michlin et al.) discloses a toner dispensing and dispensing cartridge consisting of a cylinder having a plurality of toner dispensing ports spaced along its longitudinal axis. Disposed within the interior of and extending the length of the cylinder is a multi-cup scoop, which rotates causing the dispensing of toner as the cylinder rotates. Optionally, a stationary sleeve may be disposed around the rotatable cylinder. The sleeve is provided with a plurality of openings corresponding to the location of the toner dispensing ports of the cylinder so that as the cylinder rotates, the ports periodically come into alignment with the openings thereby permitting the discharge of toner. The same problems encountered with the concentric cylinder-type designs wherein the cylinders rotate relative to one another would also be encountered in the design taught by Michlin et al. wherein only the inner cylinder rotates while the outer sleeve remains stationary.

U.S. Pat. No. 4,688,926 (Manno) discloses a reproduction machine having a rotatable toner dispensing cartridge. The toner dispensing cartridge consists of a hollow tube or cylinder having a plurality of toner discharge ports extending along its longitudinal axis and a means for controlling the timing and dumping of the toner from the toner discharge ports into a developer housing.

In one embodiment of the toner dispensing cartridge, the cylinder is provided with a plurality of spaced slot-like toner discharge ports in its surface. A rotatable, elongated toner dumping or ejecting rod is provided to control the timing and dumping of the toner from the toner discharge ports into the developer housing. This rotatable ejecting rod consists of a series of flats or recesses and is held in tight contact with the exterior surface of the cylinder extending the length of the cylinder opposite the row of toner discharge ports. As the cylinder rotates so that the toner discharge ports face the developer housing, the ejecting rod is rapidly rotated from a position where the flats are facing the toner dispensing ports and picking up toner to a position where the flats are facing toward the interior of the developer station. As a result, the toner deposited on the flats is ejected into the developer housing.

In an alternative embodiment, the cylinder has a plurality of spaced circular discharge ports in its surface extending along its longitudinal axis and is provided with an elongated rigid strip-like slide plate. This slide plate has a series of toner discharge ports capable of mating with those of the cylinder and is sealably held in position on the exterior of the cylinder opposite the row of toner discharge ports. The reciprocal sliding movement of the slide plate, in a longitudinal direction along the exterior surface of the cylinder, causes the opening and closing of the toner discharge ports thereby controlling the dispensing of toner.

The problem with this type toner resupply cartridge, is that it is mechanically complex and somewhat cumbersome. This design contains several moving parts, which increases the opportunity for malfunction and necessitates careful quality control to protect against or minimize product failure. The added quality control needed can be overly time consuming as well as add to the expense of production.

U.S. Pat. Nos. 4,611,730 and 4,878,603 disclose a toner replenishing devise that incorporates a cartridge comprising a generally cylindrical main body having opposite first and second ends, the first end being closed while the second end is open and comprises a mouth for the egress of toner. A helix-shaped guide rib is formed integrally with and in interior surface of the main body. The helix-shaped guide rib extends from the closed end to the mouth of the main body. A ring-type gear member surrounds the main body and is secured thereto proximate to the mouth for rotating the main body. The gear meshes with and is driven by a pinion gear provided by the toner replenishing device, thereby rotating the entire cartridge. As the cartridge rotates, the helix-shaped guide rib advances the toner toward and through the mouth into a toner transport path leading to the toner storage area.

SUMMARY OF THE INVENTION

The principal object of this invention is to provide a toner supply insert that is simply constructed from a minimum number of parts, which can be inserted into an empty toner supply cartridge and supply toner to the electrophotographic type reproduction machine.

Another object of this invention is to provide a toner supply insert that is removed from the empty toner supply cartridge when it is empty and is recycled for reuse.

The present invention provides a toner supply insert comprising a substantially hollow container comprising a generally cylindrical wall having a longitudinal axis, a rear portion including a closed end, and opposite thereto a front portion including an open end. The insert is adapted to be inserted into an empty toner supply cartridge of the type having front and rear cartridge portions. The front portion and the rear portion of the insert are sized to fit within the front portion and the rear portion, respectively, of the toner supply cartridge. In particular, the rear portion has a first outer diameter, and the front portion has a second outer diameter which is larger than the first outer diameter. The generally cylindrical wall of the toner supply insert may include a transition portion of connecting the front portion to the rear portion.

The toner supply insert also is provided with a handle having opposite ends, and means for connecting the opposite ends to the substantially hollow container for removing the insert from the empty toner supply cartridge when the insert is empty. In a preferred arrangement, the means for connecting comprises projections disposed on the inner wall of the front portion and which are directed inwardly. Each of the ends of the handle having an opening receiving one of the projections. In a preferred arrangement, the projections are diametrically opposed.

These and other objects and advantages of the present invention will become apparent from the following detailed description with reference to the drawings in which:

DESCRIPTION OF PRESENTLY PREFERRED EMBODIMENT(S)

Figure 1:
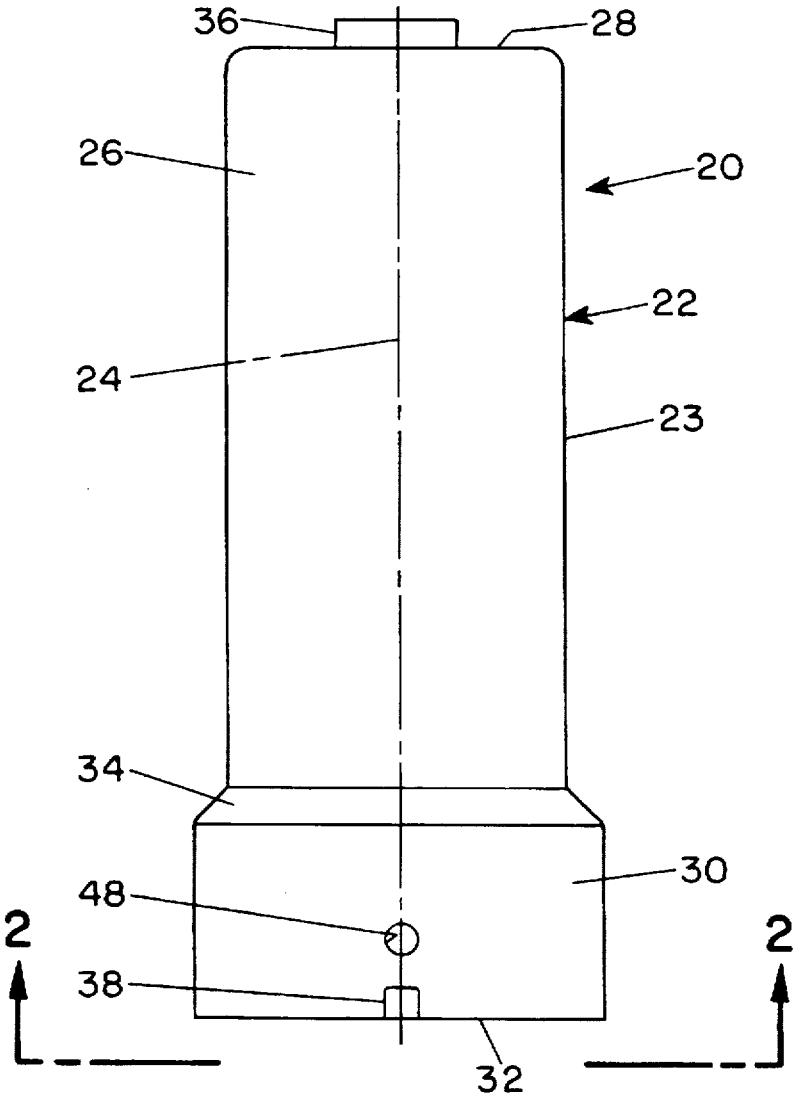
FIG. 1 is a plan view of the toner supply insert of this invention.
Figure 2:
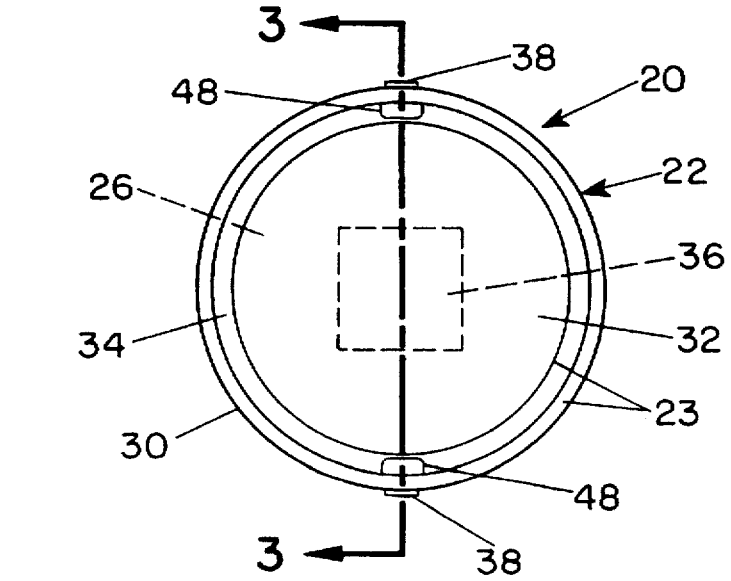
FIG. 2 is a front view of the toner supply insert as viewed from the line 2—2 of FIG. 1.
Figure 3:
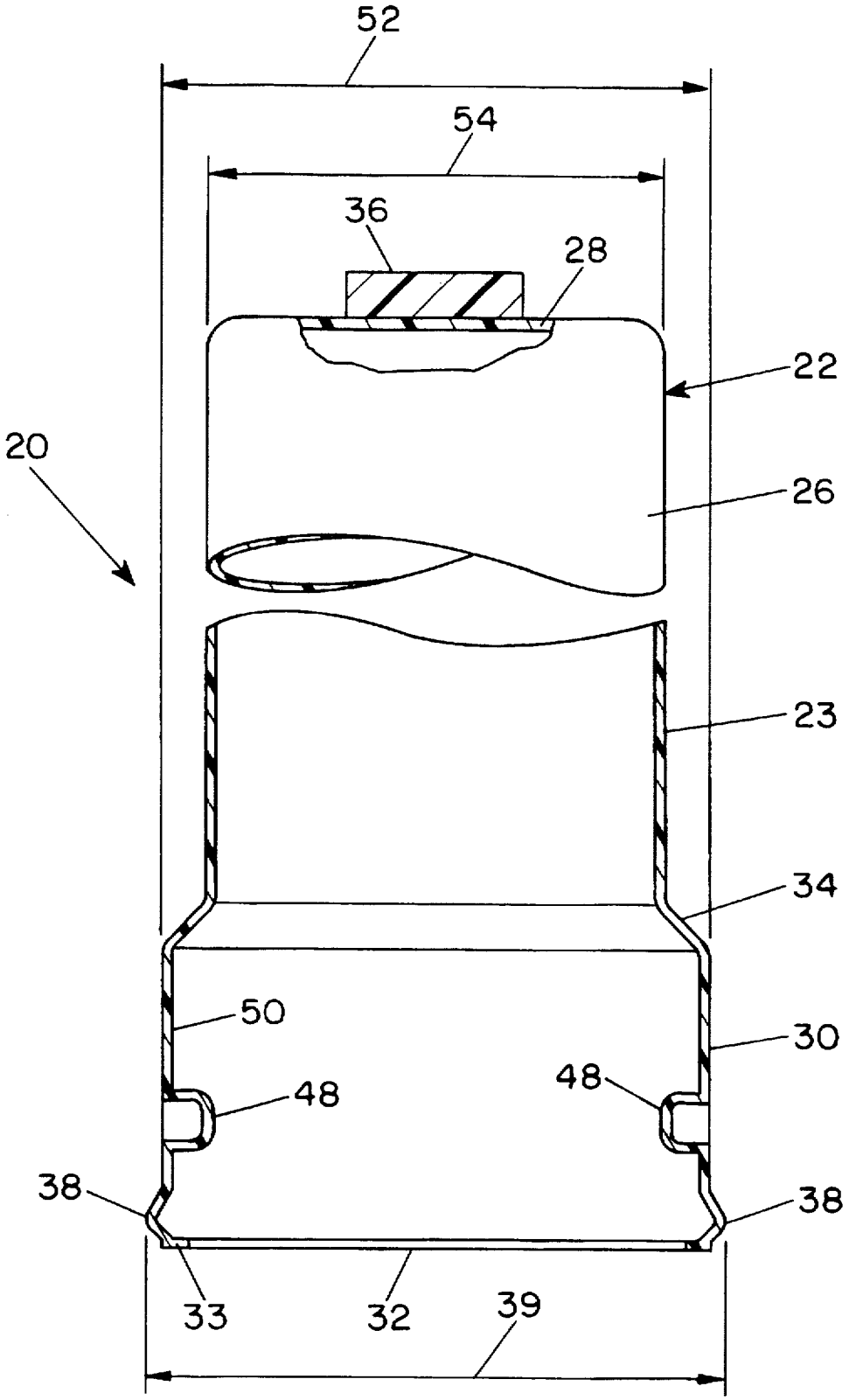
FIG. 3 is a broken cross-sectional view taken along the line 3—3 of FIG. 2, further illustrating the toner supply insert of this invention.

Referring to FIGS. 1–3, there is illustrated a toner supply insert 20 comprising a substantially hollow container 22 having a longitudinal axis 24. The container 22 comprises a generally cylindrical wall 23 having an insert rear portion 26 having a closed end 28, an insert front portion 30 having an open end 32, and a transition piece 34 connecting the insert rear portion 26 to the insert front portion 30.

The closed end 28 may be provided with a block 36 of resilient material, such as, polyurethane foam, and compressed styrofoam. Other suitable compressible foam materials may also be used. The block 36 is provided to cushion the toner supply insert 20 within an empty toner supply cartridge, such as illustrated at 59 in FIGS. 4, 5 and 8. The toner supply insert 20 also presents lugs 38 on the outer surface of the front portion 30 adjacent to the open end 32. The out-to-out dimension between the lugs 38 is indicated by the dimension line 39 in FIG. 3. As will be described, the lugs 38 serve to detachably connect the toner supply insert 20 within the empty toner supply cartridge 59.

Figure 5:
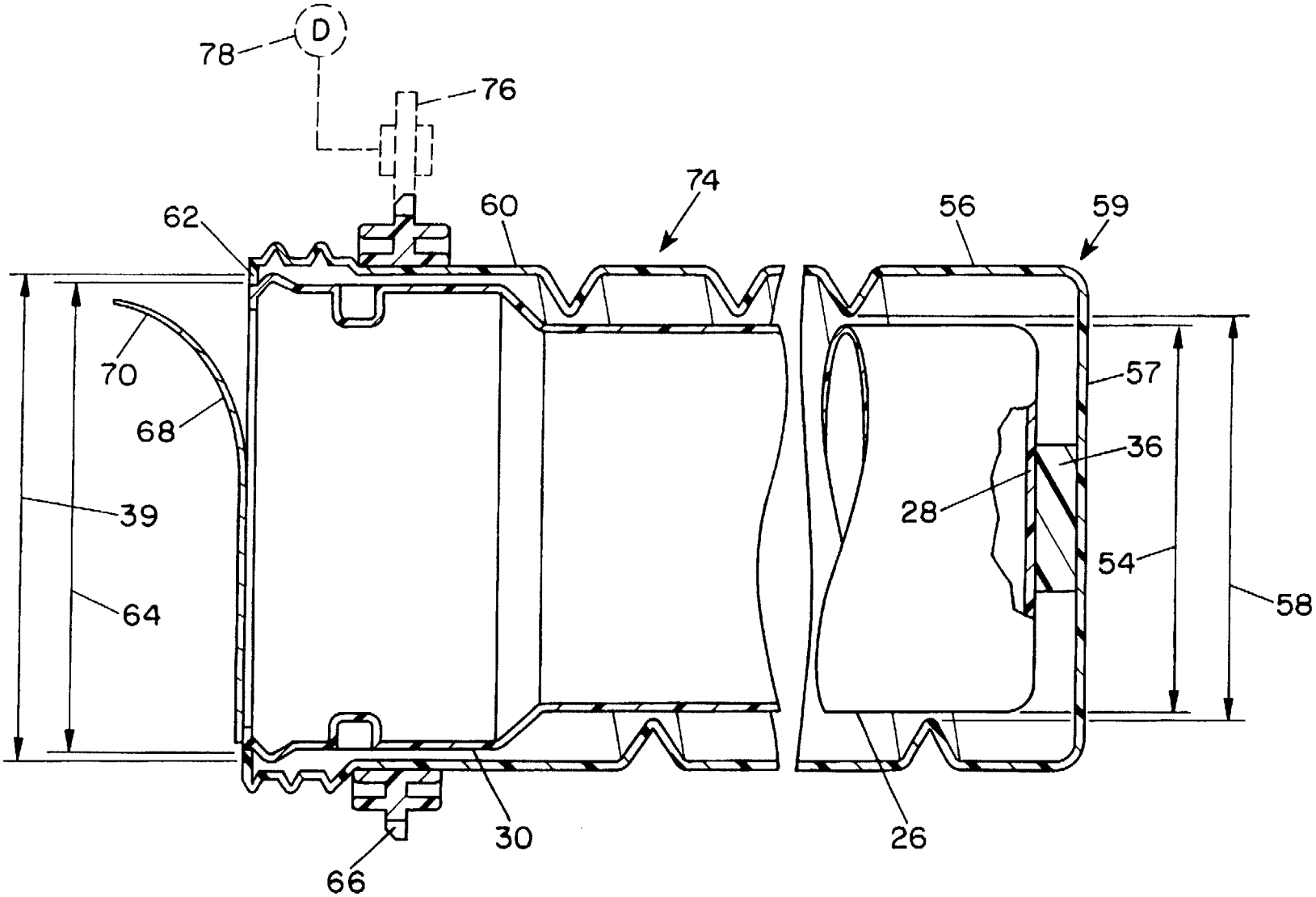
FIG. 5 is a broken cross-sectional view, taken along the line 5—5 of FIG. 4, illustrating the present toner supply insert disposed within the empty toner supply cartridge.

Referring to FIG. 3, the insert front portion 30 has an outer diameter indicated by the dimension line 52. The insert front portion 30 presents a circumferential lip 33 extending inwardly of the insert front portion 30. The insert rear portion 26 presents an end wall 57 and has an outer diameter indicated by the dimension line 54. As can be seen in FIG. 5 the empty toner supply cartridge 59 has a cartridge rear portion 56 having a minimum inner diameter indicated by the dimension line 58; and a cartridge front portion 60 has a circumferential lip 62 having an inner diameter indicated by the dimension line 64. The arrangement is such that the insert rear portion 26 and the insert front portion 30 of the toner supply insert 20 are sized to fit within the cartridge rear portion 56 and the cartridge front portion 60, respectively, of the empty toner supply cartridge 59.

The toner supply insert 20 preferably is formed from plastic material, such as, high density polyethylene or high density polypropylene.

The toner supply insert 20 is provided with a seal member 68 which is secured to the circumferential lip 33. The seal member 68 has a tab 70 which is pulled to remove the seal member 68. The seal member 68 may be formed from any suitable materials, including a polyester type film, such as MYLAR (a DuPont trademark) that is heat sealable; a polyester type film reinforced with wood or cotton fibers, such as TYVEK (A DuPont Trademark) that is adhesive applied or heat sealable; and an aluminum foil type material that is adhesive applied or heat sealable.

Figure 4:
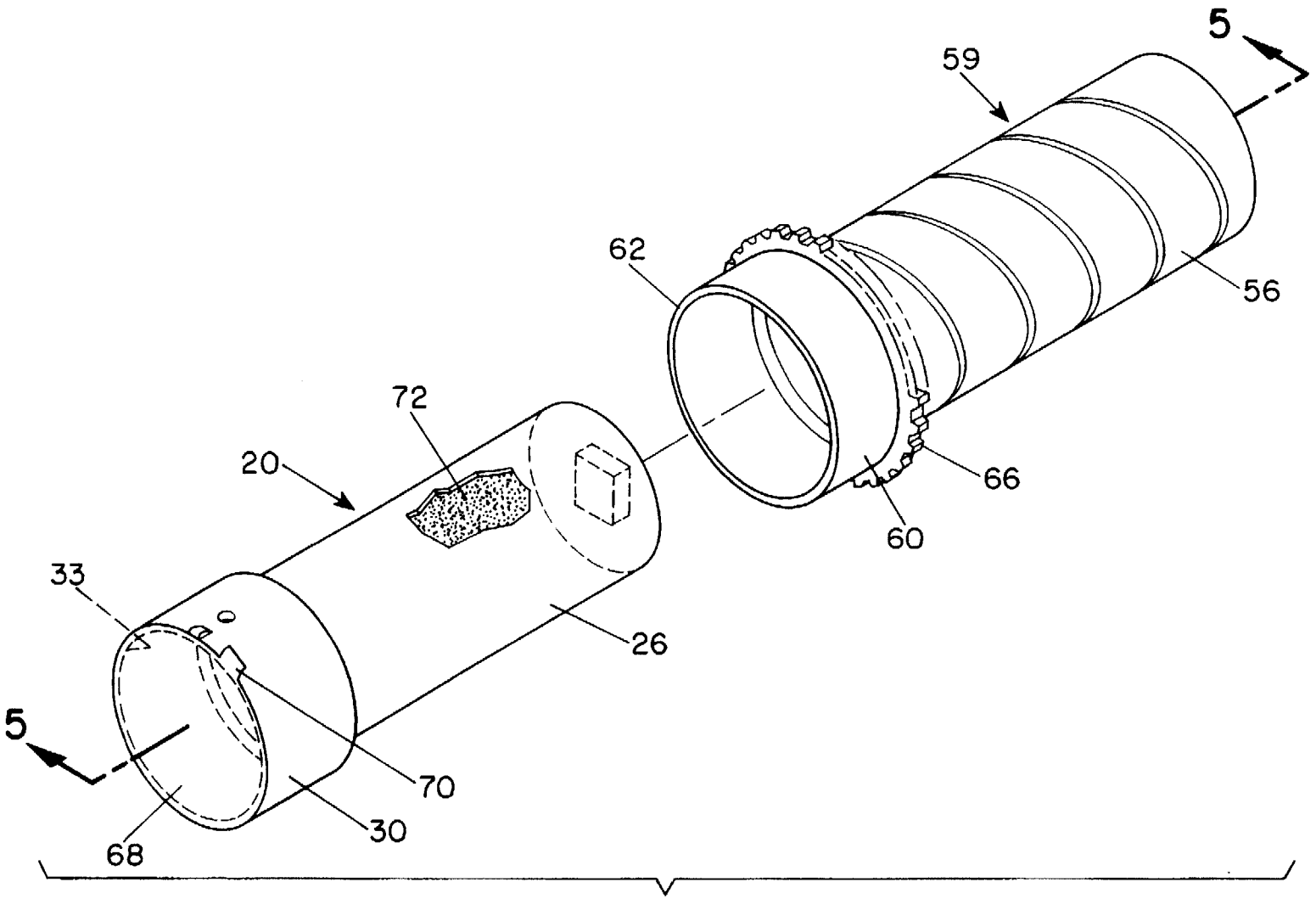
FIG. 4 is an isometric view of the present toner supply insert and an empty toner supply cartridge.

Referring to FIG. 4, the toner supply insert 20 is shown positioned to be introduced into the empty toner supply cartridge 59. The toner supply insert 20 contains a supply of toner 72, which is visible in the area wherein a portion of the generally cylindrical wall 23 that has been removed to show detail. The insert rear portion 26 and the insert front portion 30 are sized to fit within the cartridge rear portion 56 and cartridge front portion 60, respectively as shown in FIG. 5.

FIG. 5 illustrates the toner supply insert 20 inserted into the empty toner supply cartridge 59. As can be seen, the lugs 38 are received behind the circumferential lip 62 of the cartridge front portion 60 thereby detachably locking the toner supply insert 20 within the empty toner supply cartridge 59. As can be seen the block 36 is compressed between the end wall 57 of the cartridge rear portion 56 and the closed end 28 of the insert rear portion 26. The block 36 thus cooperates with the lugs 38 to insure that the toner supply insert 20 rotates with the empty toner supply cartridge 59.

The arrangement is such that the resupplied toner dispensing cartridge 74 is introduced into the toner replenishing device of a copier for transporting the toner to a developing device or a toner storage area. At that time, the gear means 66 will engage and be driven by a pinion gear 76 schematically illustrated in dotted outline in FIG. 5. A suitable drive 78 also schematically illustrated in dotted outline in FIG. 5, is provided by the electrophotographic type reproduction machine. The now resupplied supply cartridge 74 has a slight declination such that the open end 32 is slightly lower than the closed end 28. As the now resupplied toner dispensing cartridge 74 is rotated, the slight declination causes the toner 76 contained within the toner supply insert 20 is displaced toward and out through the open end 32 of the toner supply insert 20 to the developing device or a toner storage area.

Figure 6:
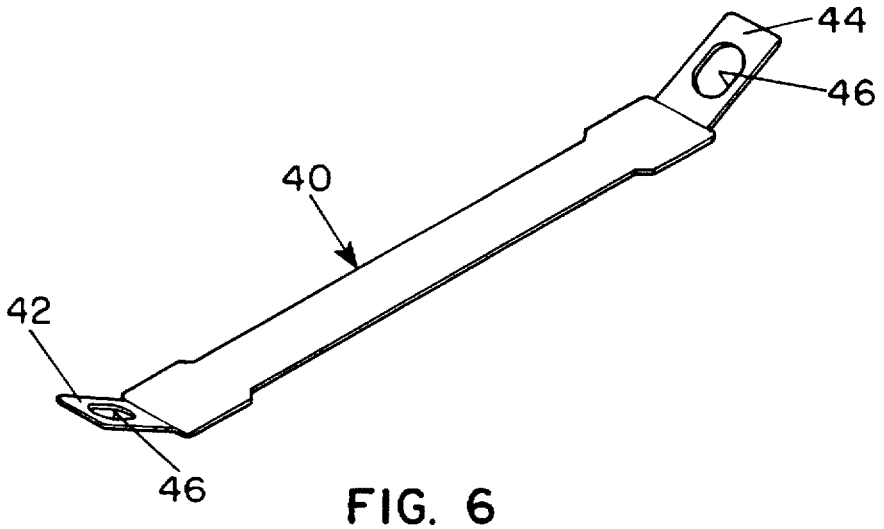
FIG. 6 is an isometric view of a handle.
Figure 7:
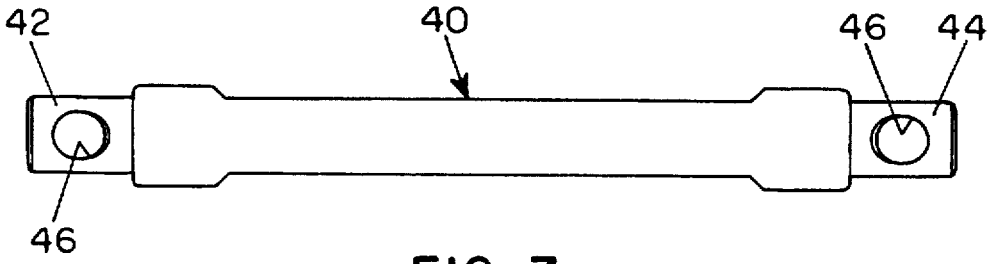
FIG. 7 is a plan view of the handle of FIG. 6.
Figure 8:
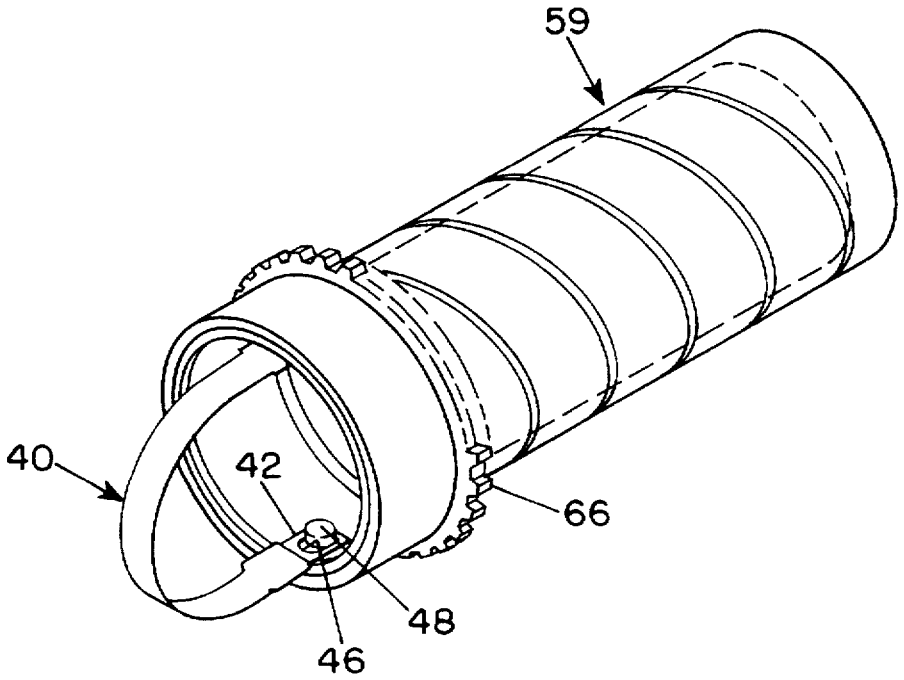
FIG. 8 is an isometric view illustrating the present toner supply insert disposed within the empty toner supply cartridge and further illustrating the handle attached to the toner supply insert.

When the resupplied cartridge 74 is empty, it is removed from the electrophotographic type reproduction machine and the now empty toner supply insert 20 is removed. To accomplish removal of the now empty toner supply insert 20 without soiling the operators hands, a handle 40 such as illustrated in FIGS. 6 and 7 is provided. The handle 40 has opposite first and second ends 42, 44 each provided with an obround opening 46. Means for connecting the handle 40 to the toner supply insert 20 is provided and comprises projections 48 which extend inwardly of the inner surface 50 (FIG. 3) toward one another. That is, the projections 48 are diametrically opposed. As shown in FIG. 8, one of the projections 48 is received in the obround opening 46 of the first end 42. It is to be understood that while not visible in FIG. 8, the obround opening 46 of the opposite or second end 46 receives the other projection 48 thereby connecting the handle 40 to the toner supply insert 20. The now empty toner supply insert 20 may be removed from the empty toner supply cartridge 59 by pulling on the handle 40, and new toner supply insert 20 inserted into the empty toner supply cartridge 59. The empty toner supply insert 20 may be recycled for refilling with fresh toner and then reused.

Although the invention has been described in detail for the purpose of illustration, it is to be understood that such detail is solely for that purpose and that variations can be made therein by those skilled in the art without departing from the spirit and scope of the invention except as it may be limited by the claims.

What is claimed is:

1. A toner supply insert comprising:

a substantially hollow container comprising a generally cylindrical wall having a longitudinal axis, a rear portion including a closed end, and opposite thereto a front portion including an open end; and said insert being adapted to be inserted into an empty toner supply cartridge having front and rear cartridge portions, said front portion and said rear portion of said insert being sized to fit within said front portion and said rear portion, respectively, of said toner supply cartridge, said toner supply cartridge being selectively integrable with and separable from an object intended for receiving toner contained in said toner supply insert, wherein said rear portion has a first outer diameter; and said front portion has a second outer diameter which is larger than said first outer diameter.

2. A toner supply insert comprising:

a substantially hollow container comprising a generally cylindrical wall having a longitudinal axis, a rear portion including a closed end; and opposite thereto a front portion including an open end;

said insert being adapted to be inserted into an empty toner supply cartridge having front and rear cartridge portions, said front portion and said rear portion of said insert being sized to fit within said front portion and said rear portion, respectively, of said toner supply cartridge, said toner supply cartridge being selectively integrable with and separable from an object intended for receiving toner contained in said toner supply insert;

a handle having opposite ends; and means for connecting said opposite ends of said handle to said substantially hollow container for removing said insert from said empty toner supply cartridge when said insert is empty.

3. The toner supply insert as defined in claim 2 wherein said means for connecting comprises:

projections on the inner wall of said front portion and directed inwardly thereof; and each of said ends of said handle having an opening receiving one of said projections.

4. The toner supply insert as defined in claim 3 wherein said projections are diametrically opposed.

5. A toner supply insert comprising:

a substantially hollow container comprising a generally cylindrical wall having a longitudinal axis, a rear portion including a closed end, and opposite thereto a front portion including an open end;

said insert being adapted to be inserted into an empty toner supply cartridge having front and rear cartridge portions, said front portion and said rear portion of said insert being sized to fit within said front portion and said rear portion, respectively, of said toner supply cartridge, said toner supply cartridge being selectively integrable with and separable from an object intended for receiving toner contained in said toner supply insert; and means at said closed end for cushioning said insert within said empty toner supply cartridge.

6. The toner supply insert as defined in claim 5 wherein said means for cushioning comprises a block of resilient material attached to said closed end.

7. A resupplied toner cartridge comprising, in combination:

an empty toner supply cartridge having a cartridge front portion having an entrance opening and a cartridge rear portion having an end wall, said toner supply cartridge being selectively integrable with and separable from an object intended for receiving toner provided by said resupplied toner cartridge; and a toner supply insert comprising a substantially hollow container comprising a generally cylindrical wall having a longitudinal axis, a rear portion including a closed end, and opposite thereto a front portion including an open end; said front portion and said rear portion of said insert being fitting within said cartridge front portion and said cartridge rear portion, respectively, of said toner supply cartridge, wherein said cartridge front portion presents a circumferential lip extending inwardly of said cartridge front portion; and lugs on the exterior surface of said insert front portion engaged behind said circumferential lip to detachably connect said toner supply insert within said empty toner supply cartridge.

8. The resupplied toner cartridge as defined in claim 7 including:

means at said closed end for cushioning said insert within said empty toner supply cartridge.

9. The toner supply insert as defined in claim 8 wherein said means for cushioning comprises a block of resilient material attached to said closed end and compressed between said closed end and said end wall.

10. A resupplied toner cartridge comprising, in combination:

an empty toner supply cartridge having a cartridge front portion having an entrance opening and a cartridge rear portion having an end wall, said toner supply cartridge being selectively integrable with and separable from an object intended for receiving toner provided by said resupplied toner cartridge;

a toner supply insert comprising a substantially hollow container comprising a generally cylindrical wall having a longitudinal axis, a rear portion including a closed end, and opposite thereto a front portion including an open end; said front portion and said rear portion of said insert being fitting within said cartridge front portion and said cartridge rear portion, respectively, of said toner supply cartridge;

a handle having opposite ends; and means for connecting said opposite ends of said handle to said substantially hollow container for removing said insert from said empty toner supply cartridge when said insert is empty.

11. The toner supply insert as defined in claim 10 wherein said means for connecting comprises:

projections on the inner wall of said front portion and directed inwardly thereof; and each of said ends of said handle having an opening receiving one of said projections.

12. The toner supply insert as defined in claim 11 wherein said projections are diametrically opposed.

* * * * *